US005343597A

United States Patent [19]

Pinto et al.

[11] Patent Number: 5,343,597

[45] Date of Patent: Sep. 6, 1994

[54] METHOD AND DEVICE FOR OPENING AND CLEANING FIBER MATERIAL

[75] Inventors: Akiva Pinto, Duesseldorf-Wittlaer; Guenter Lucassen, Haltern; Manfred Scholbrock, Duelmen, all of Fed. Rep. of Germany

[73] Assignee: Hergeth Hollingsworth GmbH, Duelmen, Fed. Rep. of Germany

[21] Appl. No.: 844,580

[22] PCT Filed: Sep. 27, 1990

[86] PCT No.: PCT/EP90/01631

§ 371 Date: May 21, 1993

§ 102(e) Date: May 21, 1993

[87] PCT Pub. No.: WO91/05095

PCT Pub. Date: Apr. 18, 1991

[30] Foreign Application Priority Data

Sep. 27, 1989 [DE] Fed. Rep. of Germany ... P3932282.3

[51] Int. Cl.[5] ..... D01B 3/00

[52] U.S. Cl. ..... 19/205; 19/200

[58] Field of Search ..... 19/200, 202, 203, 204, 19/205, 97.5, 85

[56] References Cited

U.S. PATENT DOCUMENTS

| | | | |
|---|---|---|---|
| 2,024,469 | 12/1935 | Mitchell | 19/205 |
| 2,903,749 | 9/1959 | Mitchell | 19/35 |
| 2,911,684 | 11/1959 | Hunter | 19/205 |
| 3,559,804 | 2/1971 | Lytton | 19/205 |
| 3,829,934 | 8/1974 | Neu | 19/202 |
| 4,625,368 | 12/1986 | Leifeld | 19/200 |
| 4,686,744 | 8/1987 | Shofner | 19/200 |
| 4,964,196 | 10/1990 | Schmid et al. | 19/200 |
| 5,018,245 | 5/1991 | Marzoli et al. | 19/200 |
| 5,146,652 | 9/1992 | Leifeld | 19/204 |

FOREIGN PATENT DOCUMENTS

| | | |
|---|---|---|
| 1073915 | 11/1960 | Fed. Rep. of Germany . |
| 3333750 | 2/1985 | Fed. Rep. of Germany . |
| 1107279 | 6/1955 | France . |
| 1343382 | 1/1963 | France . |
| 357307 | 5/1961 | Sweden . |
| 1545928 | 5/1979 | United Kingdom . |

*Primary Examiner*—Clifford D. Crowder
*Assistant Examiner*—Michael A. Neas
*Attorney, Agent, or Firm*—Leatherwood Walker Todd & Mann

[57] ABSTRACT

In a device for opening and cleaning fiber material with two opener rolls (2,4) rotating in the same direction and each being supported in a housing (3) side by side in parallel in a horizontal plane above grate segments (12, 14). The circles of action of the rolls almost contact in the horizontal, with a feeder (8) directed tangentially onto the one end of the first opener roll (2) in the fiber transport direction An outlet (30) protrudes horizontally from the housing (3) on the side of the housing (3) opposite the feeder (8) , through which an air flow (6, 34) feeds and discharges the fiber material, respectively. It is provided that, via the feeder (8), the fiber material is directed vertically from above between the housing (3) and the opener roll (2) onto that side of the first opener roll (2) facing away from the second opener roll (4). The sense of rotation of the opener roll (2) in the entering area of the fiber material is directed away from the second opener roll (4) corresponding to the falling direction of the fiber material in the peripheral region of the housing (3). The outlet (30) projects axially from the housing (3) between and above the opener rolls (2, 4).

18 Claims, 3 Drawing Sheets

METHOD AND DEVICE FOR OPENING AND CLEANING FIBER MATERIAL

BACKGROUND OF THE INVENTION

The invention relates to a method and a device for opening and cleaning fiber material according to the claims.

Such a method is needed to effectively clean fiber material, in particular cotton fibers, as early as possible, i.e. after a bale opening process. Automatic high performance picking and ginning methods used in cotton picking and ginning have caused a large increase in the degree of soiling of many kinds of cotton.

With the performance requirements constantly rising, the cleaning machines have to process these cotton fibers, while trying to maintain the quality of the fiber stock and treat the same most carefully. This is true all the more since the number of opening and cleaning stages in the opening room should be reduced to a minimum, as desired in practice.

In a known device for opening and cleaning fiber material (German Laid Open 10 73 915), the fiber flocks supplied are intensively cleaned by being accelerated several times during their passage through the device, while being simultaneously turned over and guided several times over the respective associated grate segments by two opener rolls. A such horizontal drum opener and cleaner has two parallel drums provided with pins and rotating in the same direction, to which fiber material is fed pneumatically in the axial direction and from which the fiber material is pneumatically taken off axially. It is a drawback of such an opening and cleaning device that the fiber material passes over the grate segments only a few times after entering the device since the fiber material, after having been caught in their axial line of flight by the air flow rotating along with the opening rolls, describes a comparatively steep helical line on the circumference of the opener rolls. As a result, the opening of the fiber material and thus the cleaning thereof is not optimal. A deflecting plate arranged above and between the opener rolls does not allow an intensification of the cleaning since it does not entail a higher number of revolutions of the fiber material around the opener rolls, but rather increases the loss in pressure of the transport air.

In a further known device for opening and cleaning fiber material (German Laid Open 33 33 750), two opener rolls, rotating in the same direction, are adjacently supported in parallel in a horizontal plane above grate segments, the circles of action almost contacting each other in the horizontal plane. Below the axis of rotation, a tapered guide sheet is arranged in the nip of the circles of action.

Similar prior art is also disclosed in the generic Swiss Patent 357307. Also in this opening and cleaning device, there is a separating plate arranged between the rolls as a baffle surface. The feed and suction channel extends transversal to the axes of the opener rolls. The separating plate causes a heavy interference with the air flow and thus causes flow losses that result in an increased consumption of air and power. Further, the implementation does not allow a sufficient separation of the air flow and the fiber material flow.

SUMMARY OF THE INVENTION

It is an object of the invention to improve a method and a device of the type mentioned above such that a separation of the air flow and the fiber material flow is improved, thereby obtaining an improved cleaning effect with reduced consumption of air and power.

The object is solved according to the invention by the features of the claims.

The fiber material fed via the feeder and carried in a transport air flow coming from the inlet side, is guided tangentially between the housing wall and the opener roll and vertically from above onto the rear end at the inlet side of the first opener roll in the direction of fiber transport, the direction of rotation of the opener roll being directed toward the housing wall in the area of inlet. In this way, the fiber material flow is separated from the transport air flow coming from the inlet side, thereby allowing, on the one hand that due to the forming of a dynamic pressure, a partial air flow, the main flow without any fiber material, may reach the outlet tube socket diagonally above the first opener roll on an almost direct path without an increased air resistance, whereas the fiber material flow, caught by the first opener roll due to its mass inertia and constituting a relatively small portion of the transport air flow, i.e. a second partial air flow, helically circles both opener rolls several times. The steepness of these helical circulations about both opener rolls is considerably reduced since in the area of the opener rolls only a small axial component of the partial air flow acts in the direction of the outlet tube socket. The axial component of the second partial air flow, tangentially circulating the opener rolls, may be induced by the first partial air flow flowing diagonally above the first opener roll. The number of circulations of the fiber material is considerably increased due to the small axial component of the second partial air flow, thereby improving the cleaning effect. The flow velocity of the first partial air flow is considerably reduced, when compared to the transport air flow, due to the widening of the cross section inside the housing, while the flow velocity of the second partial air flow adapts to the circumferential velocity of the opener rolls because of the fast rotation thereof. Since the main air flow may flow to the outlet tube socket almost unobstructedly, the consumption of air and the loss in pressure are reduced. At the end of the second opener roll facing the outlet tube socket, the fiber material may again be sucked and transported further by the transport air flow coming from the inlet side. It is an essential advantage of the present invention that no guide sheets are required in the peripheral area of the opener rolls, which would cause a loss in pressure.

A preferred embodiment provides that the first opener roll in the fiber transport direction is provided with needles. This opener roll equipped with needles allows a finer disintegration of the fed fiber flocks and, as a result, allows a better separation of foreign matter particles at the first grate segment in the fiber transport direction.

The second opener roll in the fiber transport direction may be at least partly equipped with pins fastened on air conveying bars. The bars on this opener roll increase the air flow carried along and thereby improve the separation rate for smaller foreign matter particles at the second grate segment, too.

In one embodiment it is contemplated that the opener rolls are slanted downward from the inlet side to the outlet side. Such slanting offers the advantage that the helical advancing movement is supported by gravity.

In the first collecting chamber below the guide sheet between the grate segments of the opener rolls, large and heavy particles of foreign matter that due to their size could not be separated at the grate segments, can be collected advantageously. It is an essential advantage of this collecting chamber that the separation of large and heavy particles of foreign matter can be effected with only a negligible loss of fibers, because the opening of the inlet slit may have a rather large cross section, but the closed collecting chamber does not allow any substantial air flow. Due to the air taken along by the opener rolls, there may be a considerable swirl in the first collecting chamber, which, however, has fiber flocks that may have fallen into the collecting chamber to be blown out of the chamber again so that, finally, only the heavy particles that could cause considerable breakdown are collected in the collecting chamber.

The collecting chamber may be connected with, or separated by, a first discharge channel via a flap or the like. The flap leading to the first discharge channel may be opened at regular or irregular intervals, the foreign matter falling into the first discharge channel which is emptied after the flap has been shut.

Preferably, the guide sheet is a baffle wedge of triangular cross section, the tip of which points upward. Heavy particles that are pressed outward for reasons of centrifugal forces hit against the baffle wedge and fall into the collecting chamber.

In an advantageous embodiment, it is provided that the first inlet slit in the fiber transport direction is delimited by an adjustable guide sheet extending over the entire length of the opener rolls, by which the baffle angle of the fiber material flow onto the baffle wedge is adjustable.

Preferably, it is provided that a funnel-shaped second collecting chamber is arranged below the grate segments, into which the first collecting chamber and the first discharge channel project, a second discharge channel being provided at the lower end of the second collecting chamber for a continuous discharge of the smaller foreign matter particles of the fiber material, e.g. trash, separated at the grate segments. In this way, trash material and separated heavy particles can be discharged separately and lead to different collecting sites.

Preferably, the feeder is disposed above the first opener roll on the side opposite the discharge channels. The fiber material falls vertically from above on the first opener roll and is fed forward from there by a screw motion caused by the rotary motion of the first opener roll.

Further advantageous features are contained in the further dependent claims.

The following is a detailed description of embodiments of the invention with reference to the accompanying drawings.

DESCRIPTION OF THE PREFERRED EMBODIMENT

Figure 1:
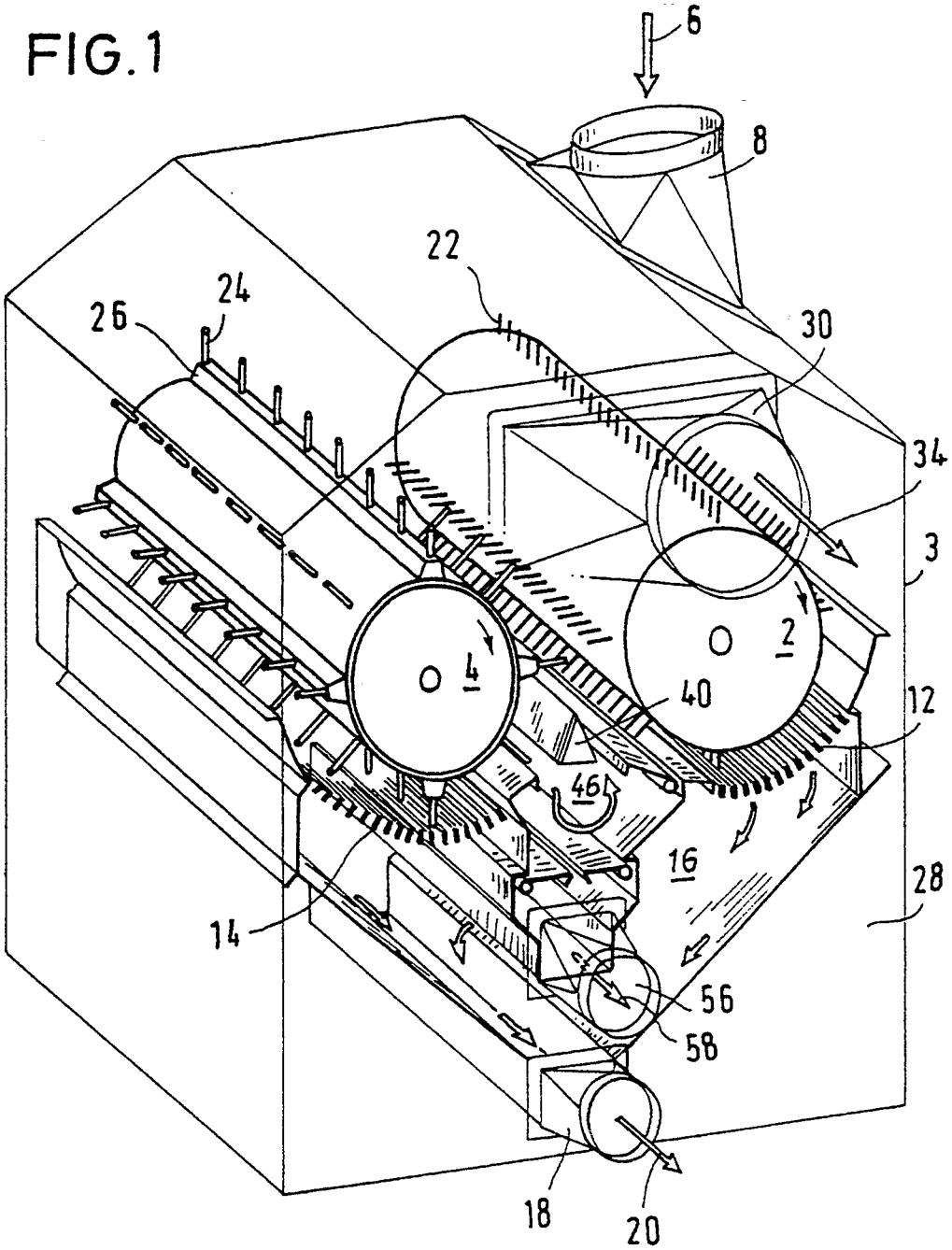
FIG. 1 is a perspective view of the opening and cleaning device.
Figure 2:
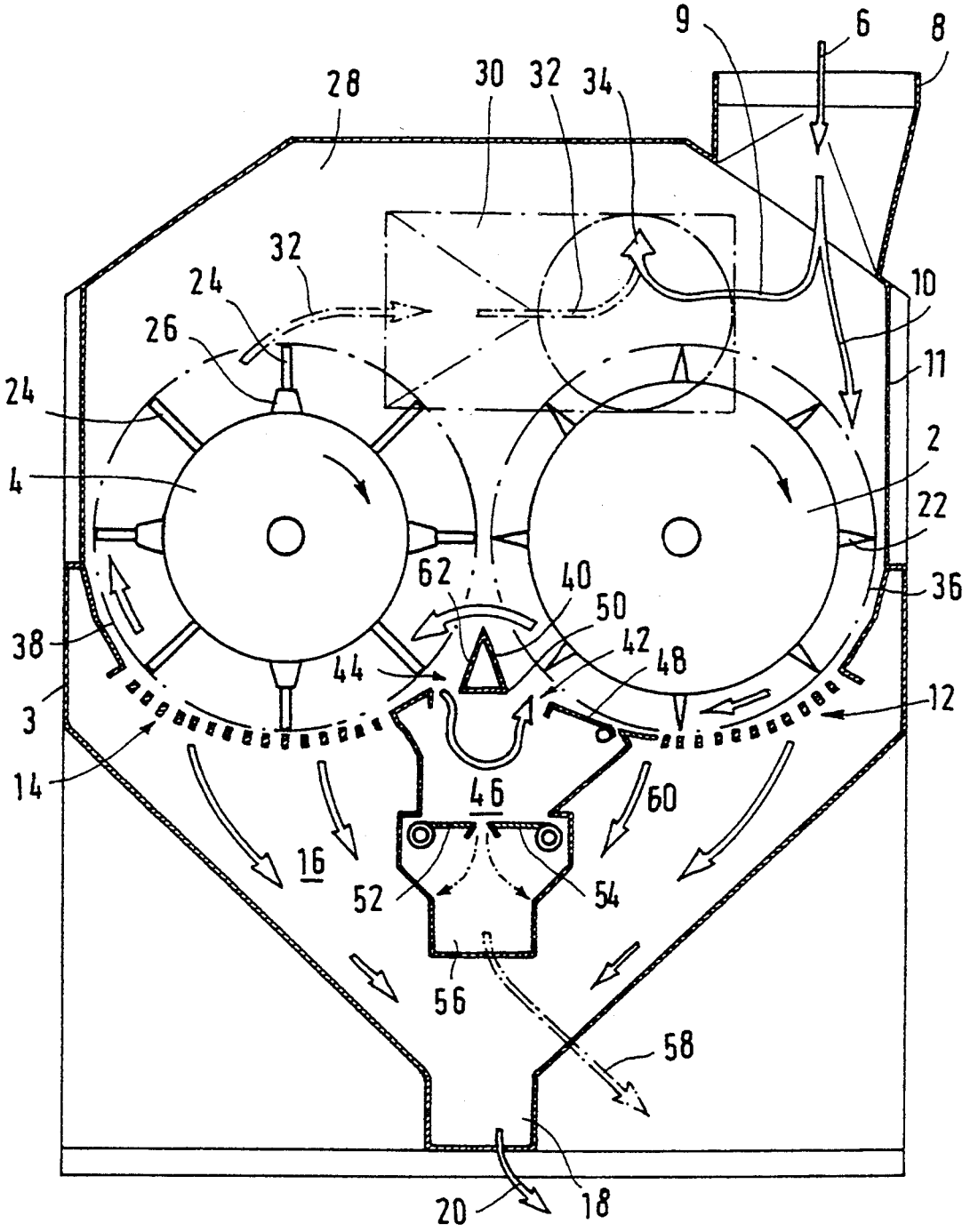
FIG. 2 is a schematic front view of the opening and cleaning device.
Figure 3:
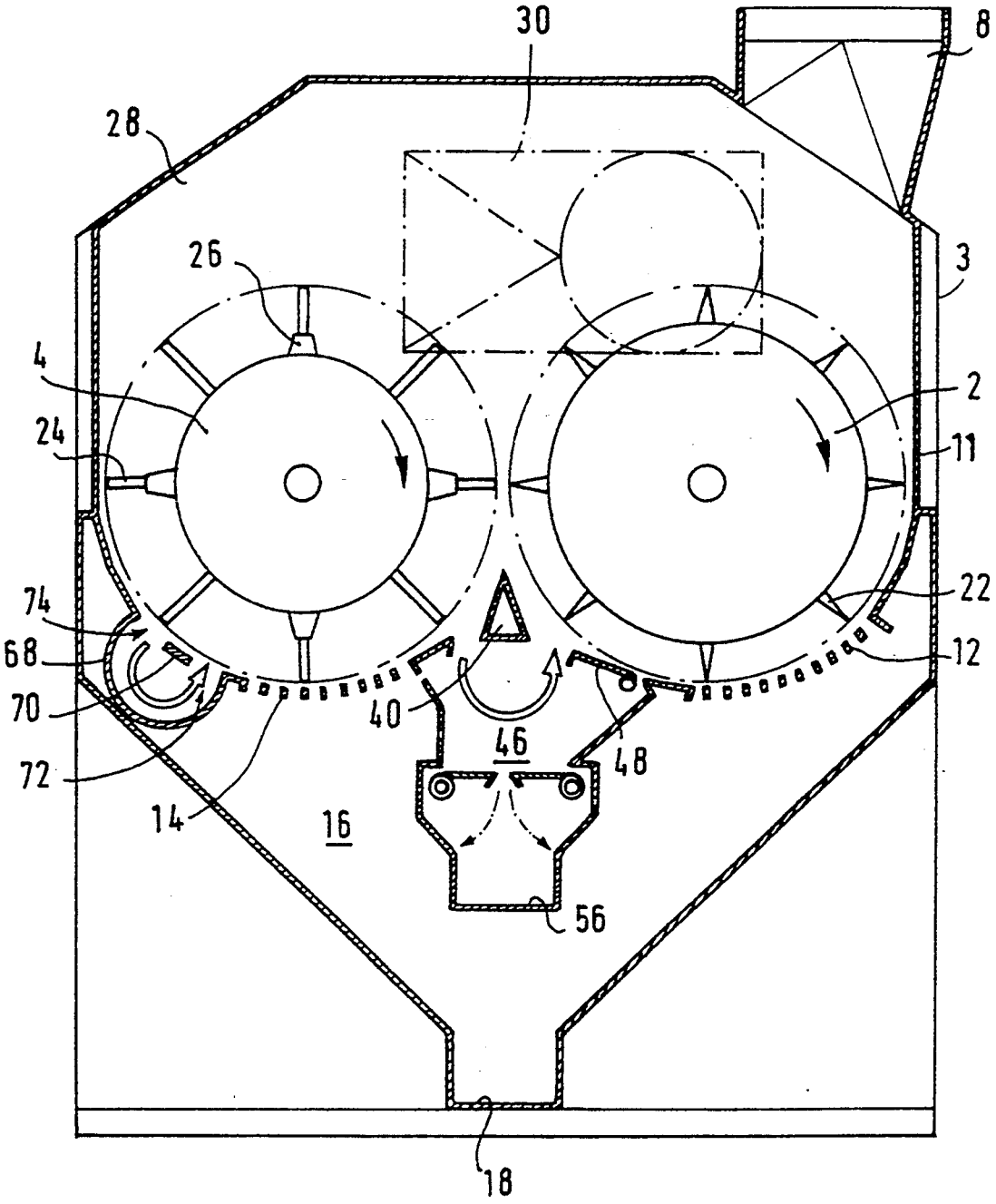
FIG. 3 is a front view of a second embodiment.

The opening and cleaning device is provided with a pair of mutually parallel opener rolls 2 and 4, depicted in FIGS. 1 to 3 as being horizontal, which are supported in a housing 3. First, the fibers are fed vertically by the flow of transport air 6 through the feeder 8 at one end of the opener roll 2, then, supported by a partial air flow 10 and without any axial interfering component of the transport air flow 6, they are moved axially and helically along the length of the opener rolls 2,4 which rotate at high speed. As a partial air flow 9 of the transport air flow 6, the far greater main air flow flows above the opener rolls 2, 4 almost in parallel to the opener rolls 2,4 to an outlet tube socket 30, emerging from the housing 3 between the opener rolls 2,4 at a place horizontally and axially above the same, the main flow merging there with the partial air flow 32, resulting partly from the partial airflow 10 and being partly generated by the opener roll 4, to form the transport air flow 34 for carrying off the cleaned fiber material. Due to gravity and inertia, the fiber material does not follow the main air flow in the partial air flow 9. In contrast thereto, the partial air flow 9 will inevitably be formed due to the dynamic pressure.

It is essential that the entering transport air flow 6 has no axial component, but is directed substantially tangentially onto the first opener roll in the transport direction. In the constantly narrowing nip between the opener roll 2 and the housing wall 11, only a partial air flow 10 is carried along with the fiber material, while the partial air flow 9, deflected axially, remains in a plane above the two opener rolls 2, 4 and flows almost directly to the outlet tube socket 30. Due to the rather weak axial component of the partial air flow 10, the fiber material may circulate particularly often around both opener rolls 2, 4, thereby allowing a particularly intensive cleaning. The circulation path of the fiber material around the opener rolls 2, 4 takes the shape of an 8, seen in the axial direction, the change to the respective other opener roll 2, 4 taking place between the respective opener rolls 2, 4, due to their rotating in the same direction.

The axes of the opener rolls 2, 4 may also extend obliquely with respect to the horizontal, whereby the circulation rate of the fiber material may be influenced. In an embodiment not shown, the mutually parallel axes are inclined downward to the outlet side.

In the case of stronger axial components of the partial air flow 10, directed to the outlet side, or axial components of the air flow, induced by the partial air flow 9, surrounding the opener rolls 2, 4, one may also have the axes rise towards the outlet tube socket 30 in order to increase the circulation rate of the fiber material.

Impurities separated by the opener rolls 2, 4 fall through grate segments 12, 14 into a funnel-shaped collecting container 16 arranged below the grate segments, from where they may be sucked by a continuous flow of transport air 20 via a discharge channel, e.g. a suction channel 18, or from where they are removed mechanically. The opener rolls 2, 4 rotate continuously, while the fibers are transported along the opener rolls. The first opener roll 2 in the direction of the fiber transport is equipped with needles 22 arranged one behind the other in the longitudinal direction of the opener roll and extending radially outward. These needles provide a careful and intensive cleaning of the fibers as they flow through the cleaning device. In contrast thereto, the opener roll 4 is provided with pins 24 that are also arranged one behind the other in the longitudinal direction of the rolls, every second row of pins being arranged on an air-conveying bar 26 that serves to increase the swirling of the air and the amount of air carried along at the roll 4. In doing so, it is provided that the amount of air carried along by the air-conveying bars 26 is forced into collecting chambers to be described hereafter.

The needles in the opener rolls 2 cause an improved opening of the fiber material supplied as flocks.

From the outlet side end of the opener roll 4, the cleaned fiber material in the front face 28 of the housing 3 opposite the feeder 8 is transported to the next working stage in the transport air flow 34 via the outlet tube socket 30. In doing so, the fiber material is transported from the opener roll 4 to the outlet tube socket 30 in a partial air flow 32 by the suction effect of the partial air flow 9 and merged to form the transport air flow 34. The partial air flow 32 is at least partly generated by means of the air-conveying bars 26.

In the nip between the two circles of action 36, 38 of the opener roll 2, 4, i.e. below the rotational axes of the rolls, a baffle wedge 40 of triangular cross section with an upward directed tip is arranged. The baffle wedge 40 extends over the entire length of the opener rolls 2, 4 and parallel thereto. On both sides of the baffle wedge 40, a respective wide inlet slit 42, 44 is provided, which is associated to a respective one of the opener rolls 2, 4, through which slit heavy and large foreign matter is separated into a collecting chamber 46. This collecting chamber 46 also extends over the entire length of the opener rolls and has its portion facing the opener roll 2 provided with an angularly adjustable guide sheet 48. Both inlet slits 42, 44 are adjustable in their width.

The collecting chamber 46 is closed at the bottom by two pivotable bottom flaps 52, 54 so that it is sealed from the discharge channel existing beneath these bottom flaps 52, 54.

The air carried along by the opener rolls 2, 4 may well cause swirls (indicated by an arrow in the Figures) in the collecting chamber 46, which, however, are utilized insofar as fibers that have gotten into the collecting chamber 46 are blown out again, while heavy and large particles will remain in the collecting chamber and are discharged from there either at regular or optional intervals by opening the flaps 52, 54. In doing so, the foreign matter contained in the collecting chamber 46 will first get into a discharge channel 56, extending over the entire length of the collecting chamber 46, from which channel it may then be transported further in an air flow 58, after the flaps 52, 54 have been closed.

Thus, the opening and cleaning device also allows the supply of heavy and large foreign matter separate from smaller foreign matter and trash separated at the grate segments 12, 14 to different collecting sites.

Thus, smaller foreign matter is separated at the grate segments 12, 14, whereas larger foreign matter that cannot pass the grate bars is collected in the collecting chamber 46. The two discharge channels 18 and 56 are also located in the front side 28 of the opening and cleaning device.

In the direction of rotation, the grate segments 12 of the opener roll 2 begin at an angle of 45° relative to the horizontal and terminate in an angular range of 5° to 10° behind the vertical. Contiguous thereto, a guide sheet may be additionally provided that is concentric relative to the rotational axis of the opener roll 2. There may also be provided the side wall 60 of the collecting chamber 46, the adjustable guide sheet 48 being joined to the end of the wall 60 facing the opener roll 2.

The surface 62 of the baffle wedge 40 facing the opener roll 4 serves as a guide surface for the foreign matter accelerated radially outward by the beating action of the pins 24 of the opener roll 4, as well as for the air carried along by the air-conveying bars 26, the guide surface 62 directly guiding the foreign matter and the air into the collecting chamber 46 via the inlet slit 44. The air may escape from the collecting chamber 46 via the inlet slit 42, thereby blowing out the light fibers and feeding these to the opener roll 2.

FIG. 3 illustrates a second embodiment, wherein the second opener roll 4 also has a collecting chamber 68. The third collecting chamber 68 is arranged subsequent to the grate segment 14 in the direction of rotation and may be emptied, e.g., via an opening in the front wall 28. The collecting chamber 68 is open towards the opener roll 4, a guide sheet 70 being arranged in the opening. The guide sheet forms two opening slits 72, 74. Thus, the air carried along by the air-conveying bars 26 can also flow through the collecting chamber 68 and carry out fibers contained therein, whereas heavy particles will remain within the collecting chamber. An asymmetric arrangement of the guide sheet 70 may cause a varying dynamic pressure within the opening slits 72, 74 so that the air may enter by one opening slit and escape by the other.

The features of the present invention as disclosed in the above specification, the Figures and the claims, even if they are described in connection with a certain embodiment, are intended to be essential for the realization of the various embodiments of the invention both as individual features or in any combination thereof.

We claim:

1. A method for opening and cleaning fiber material, comprising:

transporting the fiber material to an inlet of a housing of an opening and cleaning device in a transport air flow entering the housing, said opening and cleaning device rotating in said housing;

introducing the transport air flow substantially vertically from above said opening and cleaning device;

directing the transport air flow onto an outer peripheral region between the opening and cleaning device and the housing in the direction of rotation of said opening and cleaning device;

dividing the transport air flow adjacent the outer peripheral region of the housing, said divided transport air flow forming first and second partial air flows, said first partial air flow being substantially free of fiber material and said second partial air flow being directed substantially downwardly for carrying the fiber material about the rotating opening and cleaning device;

deflecting said first partial air flow such that said first partial air flow substantially flows above said opening and cleaning device;

merging said first partial air flow with a third partial air flow occurring at an outlet of the housing of said opening and cleaning device to form an outflow transport air flow;

circulating the fiber material about the rotating opening and cleaning device; and transporting away the cleaned fiber material from the outlet of the housing of the opening and cleaning device in the outflow transport air flow.

2. A device for opening and cleaning foreign matter from fiber material, comprising:

a housing having an outlet side defining an outlet for delivering the fiber material;

first and second opener rollers associated with said housing for rotation in the same direction as one another, said first and second opener rollers each being substantially cylindrical and extending substantially parallel to and in close proximity with one another to form a nip zone therebetween, said first opener roller defining a first end and a second end opposite said first end, said outlet being spaced opposite said first end of said first opener roller and being proximate said second end of said first opener roller;

at least one grate segment associated with said housing and positioned below said first and second opener rollers for receiving foreign matter;

at least one guide sheet positioned below said nip zone and extending substantially the length of said first and second opener rollers;

a first collecting chamber adjacent said at least one grate segment for collecting foreign matter from the fiber material, said first collecting chamber defining a first inlet slit adjacent said first opener roller and adjacent said at least one guide sheet;

a second collecting chamber below and in communication with said at least one grate segment and said first collecting chamber;

a discharge channel positioned below and in communication with said at least one grate segment for discharging foreign matter received by said at least one grate segment;

a feeder associated with said housing, said feeder configured to downwardly direct fiber material tangentially onto said first end of said first opener roller; and said housing defining a peripheral portion adjacent said first end of said first opener roller and flow path for carrying the fiber material from said feeder to said outlet, such that said feeder directs the fiber material to between said first end of said first opener roller and said peripheral portion of said housing opposite said second opener roller, and such said first opener roller rotates in a direction to cause the fiber material to be directed downwardly between said first opener roller and said peripheral portion of said housing.

3. A device for opening and cleaning foreign matter from fiber material, comprising:

a housing having an outlet side defining an outlet for delivering the fiber material;

first and second opener rollers associated with said housing for rotation in the same direction as one another said first and second opener rollers each being substantially cylindrical and extending substantially parallel to and in close proximity with one another to form a nip zone therebetween said first opener roller defining a first end and a second end opposite said first end, said outlet being spaced opposite said first end of said first opener roller and being proximate said second end of said first opener roller;

at least one grate segment associated with said housing and positioned below said first and second opener rollers for receiving foreign matter;

a feeder associated with said housing, said feeder being configured to downwardly direct fiber material tangentially onto said first end of said first opener roller; and said housing defining a peripheral portion adjacent said first end of said first opener roller and flow path for carrying the fiber material from said feeder to said outlet, such that said feeder directs the fiber material to between said first end of said first opener roller and said peripheral portion of said housing, opposite said second opener roller, and such said first opener roller rotates in a direction to cause the fiber material to be directed downwardly between said first opener roller and said peripheral portion of said housing.

4. The device as defined in claim 3, wherein said outlet projects axially from said housing above said first and second opener rollers.

5. The device as defined in claim 3, wherein the first opener roller is equipped with needles.

6. The device as defined in claim 3, wherein the second opener roller includes air-conveying bars and a plurality of pins mounted on said air-conveying bars.

7. The device as defined in claim 3, wherein the axes of said first and second opener rollers extend at an angle relative to the horizontal from the feeder to the outlet at the outflow side.

8. The device as defined in claim 7, wherein said first and second opener rollers are inclined downward toward to the outflow side.

9. The device as defined in claim 3, further comprising: said first and second opener rollers being of substantially the same length; at least one guide sheet positioned below said nip zone and extending substantially the length of said first and second opener rollers; a first collecting chamber for collecting heavy and large foreign matter from the fiber material arranged adjacent said at least one grate segment below said first and second opener rollers, said first collecting chamber extending substantially the length of said first and second opener rollers, said first collecting chamber having a first inlet slit provided on the side of the guide sheet facing the first opener roller, said first inlet slit being substantially parallel to the first and second opener rollers.

10. The device as defined in claim 9, further comprising a first discharge chamber adjacent said first collecting chamber, said first collecting chamber being separated from said first discharge channel by a flap.

11. The device as defined in claim 9, wherein said at least one guide sheet includes a baffle wedge of substantially triangular cross section, having an upwardly pointing tip portion.

12. The device as defined in claim 9, further comprising a second collecting chamber arranged below said at least one grate segment into which said first collecting chamber projects, a first discharge channel positioned adjacent said first collecting chamber, said first discharge channel projecting into said second collecting chamber, a second discharge channel being arranged at the lower end of the second collecting chamber for continuously discharging smaller foreign matter of the fiber material separated at said at least one grate segment.

13. The device as defined in claim 9, wherein said guide sheet is adjustable and defines the first inlet slit in the fiber material transport direction, said guide sheet extending substantially the entire length of the first and second opener rollers.

14. The device as defined in claim 9, wherein said guide sheet defines a second inlet slit extending substantially the entire length of the first collecting chamber, is provided on the longitudinal side of said guide sheet facing the second opener roller.

15. The device as defined in claim 14, wherein said first and second inlet slits are adjustable in their width.

16. The device as defined in claim 9, wherein said feeder feeds the fiber material vertically from above on the portion or the first opener roller opposite said first and second discharge channels.

17. The device as defined in claim 3, further comprising a third collecting chamber adjacent said at least one grate segment and said second opener roller, said third collecting chamber defining an opening facing said second opener roller extending substantially the entire length of said second opener roller.

18. The device as defined in claim 17, further comprising a second guide sheet which divides the opening of said third collecting chamber such that at least two opening slits are formed.

* * * * *